US007481685B2

(12) United States Patent
Fukaya et al.

(10) Patent No.: US 7,481,685 B2
(45) Date of Patent: Jan. 27, 2009

(54) FEMALE TERMINAL FITTING

(75) Inventors: Tomoyoshi Fukaya, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/820,771

(22) Filed: Jun. 20, 2007

(65) Prior Publication Data

US 2008/0096442 A1 Apr. 24, 2008

(30) Foreign Application Priority Data

Jun. 21, 2006 (JP) ..... 2006-171504

(51) Int. Cl.
*H01R 11/22* (2006.01)

(52) U.S. Cl. ..... 439/852; 439/595

(58) Field of Classification Search ..... 439/852, 439/595

See application file for complete search history.

(56) References Cited

U.S. PATENT DOCUMENTS 5,441,428 A 8/1995 Hamai et al.

2002/0160666 A1 10/2002 Sato et al.

FOREIGN PATENT DOCUMENTS

JP 2006012741 1/2006

*Primary Examiner*—Truc T Nguyen
(74) *Attorney, Agent, or Firm*—Gerald E. Hespos; Anthony J. Casella

(57) ABSTRACT

A female terminal fitting (10) has a tube (12) with a tab insertion opening (12A) for receiving a male tab (80). A contact piece (30) and receiving pads (17) are provided in the tube (12) for sandwiching the male tab (80). The contact piece (30) includes a resiliently deformable contact main body (31) that is curved to come closer to the receiving pads (17) and can resiliently contact a widthwise middle part of a plate surface of the male tab (80) at a convex contact position along the curve. Shake preventing portions (32) are formed at opposite sides of the contact main body (31) and contact opposite sides of the male tab (80) for preventing the male tab (80) from shaking about the center of axis thereof.

14 Claims, 8 Drawing Sheets

FEMALE TERMINAL FITTING

BACKGROUND OF THE INVENTION

1. Field of the Invention

The invention relates to a female terminal fitting.

2. Description of the Related Art

Japanese Unexamined Patent Publication No. 2006-12741 discloses a long narrow female terminal fitting with opposite front and rear ends. A tube is formed at the front end of the female terminal fitting and is dimensioned to receive a mating male tab. A barrel is formed at the rear end and is configured to be connected with an end of a wire. A contact piece in the form of a leaf spring is formed separate from the tube, but is inserted in the tube. The contact piece has a main body that is curved in a substantially U-shape. The main body has contact portion with a convex surface disposed for contacting a male tab. The male tab inserted into the tube is connected electrically with the female terminal fitting while being resiliently sandwiched between the contact portion of the contact piece and a receiving pad in the tube. The contact piece further includes a holding portion that is connected integrally to the opposite widthwise edges of the contact main body. Engaging pieces project out from the opposite widthwise sides of the holding portion. The engaging pieces are engaged and supported in engaging holes that penetrate the opposite side walls of the tube. In this way, the contact piece is held in the tube.

The male tab and the contact portion are held only in point or line contact. The wire connected with the female terminal fitting may be shaken, and a shaking movement of the wire causes the tube to shake as well. Accordingly, the male tab inserted in the tube shakes about the center of axis of the male tab and may roll the tube. As a result, the contact reliability of the male tab and the female terminal fitting can be impaired.

The invention was developed in view of the above situation and an object thereof is to prevent the contact reliability of a male tab and a female terminal fitting from being impaired.

SUMMARY OF THE INVENTION

The invention relates to a female terminal fitting with opposite front and rear ends. A tube is formed adjacent the front end and has a tab insertion opening at the front end for receiving a male tab. A contact piece is arranged at least partly in the tubular portion and cooperates with a receiving pad in the tube to sandwich the male tab. The contact piece includes a resiliently deformable contact main body that is curved in the thickness direction to come closer to the receiving pads. The contact piece resiliently contacts a widthwise intermediate part of the male tab at a convex contact position of the curve. At least one shake preventing portion is formed along lateral sides of the contact main body and contacts the widthwise sides of the male tab to prevent the male tab from shaking about the center of axis.

The widthwise intermediate part of the male tab resiliently touches the contact main body of the contact piece at the contact position when the male tab is inserted to a proper depth in the tube. Therefore the widthwise sides of the male tab can contact the shake preventing portions of the contact piece substantially along the inserting direction of the male tab. A wire connected with the female terminal fitting may be shaken in this state. However, the contact of the sides of the male tab with the shake preventing portions prevents the male tab from shaking about the center of axis thereof. Therefore the relative position of the male tab in the tube can be held substantially immovably. As a result, shaking movements or rolling movements of the male tab in the tube can be suppressed to improve the contact reliability of the male tab and the female terminal fitting.

The shake preventing portions preferably extend at least in an area from the tab insertion opening to the contact position. As a result, the contact reliability can be improved further and shaking movements of the male tab in or about longitudinal inserting direction of the male tab can be effectively suppressed effectively.

There is a possibility that shaking movements of the male tab will not be suppressed sufficiently by the shake preventing portions, if the contact piece itself moves loosely in the tube when the wire is shaken. Accordingly, the contact piece preferably includes supports that stand up substantially in the thickness direction of the shake preventing portions. Upper or outer ends of the supports contact the inner surface of the tube to suppress shaking movements of the male tab and to prevent loose movements of the contact piece.

The contact piece preferably is formed separate from the tube, and preferably is held at least partly in the tube by the engagement of one or more engaging portions at edges of the shake preventing portions at or near the sides of the contact piece and one or more engagement receiving portions at the side walls of the tube. The formation of the contact piece separate from the tube enables the contact piece to be thinner than the tube. A thin contact piece ensures smooth deformations even if the thickness of the tube is increased to accommodate a thick wire for a large current. A thick wire is more likely to transmit vibrations to the female terminal fitting, and is more likely to impair the contact reliability with the male tab. However, the shake preventing portions suppress shaking or rolling movements of the male tab.

The contact position preferably is distanced from contact surfaces of the shake preventing portions with the male tab in height direction when the contact main body is not connected with the male tab. Accordingly, a contact pressure of the contact main body with the male tab can be set to a proper value so that the shake preventing portions normally do not strongly press the male tab. Therefore, the insertion resistance of the male tab need not be large.

One or more pressing portions preferably project substantially towards the base plate to prevent excessive deformation of the contact main body. The pressing portions preferably are formed by making longitudinal cuts in side walls of the tube and applying forces to sides of the tube between cuts to deform these areas into substantially wave-like, pointed or rounded shapes.

The contact main body preferably has a curved wavy shape.

The shake preventing portion preferably comprises a hanging portion bent at an angle towards the base plate from the corresponding lateral edge of the front end of the contact main body.

Most preferably, the shake preventing portion further has a shake preventing body that is bent to bulge out from the bottom end of the hanging portion. Thus, the shake preventing portion preferably has an L-shape.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
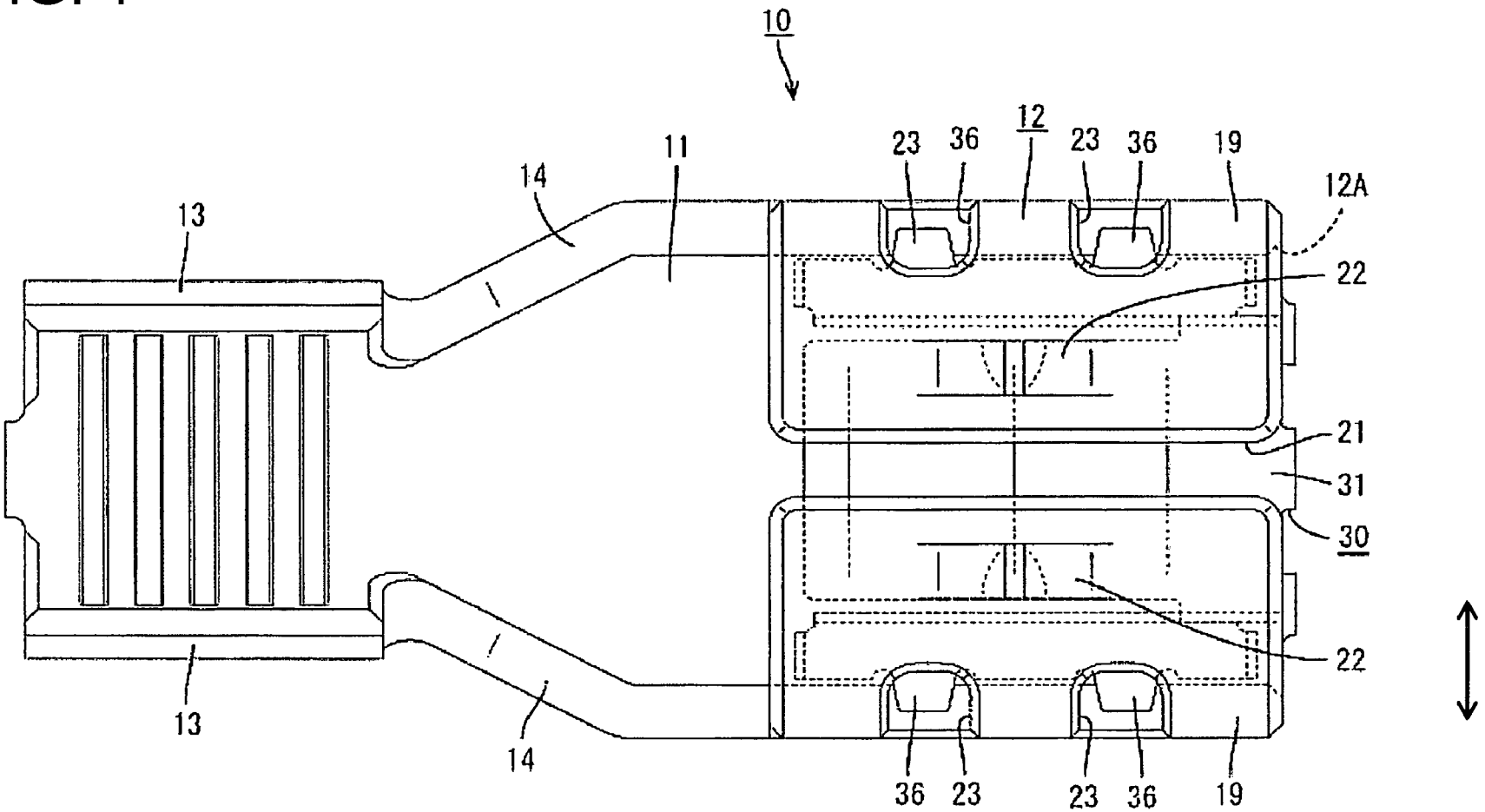
FIG. 1 is a plan view of a female terminal fitting according to the invention.
Figure 2:
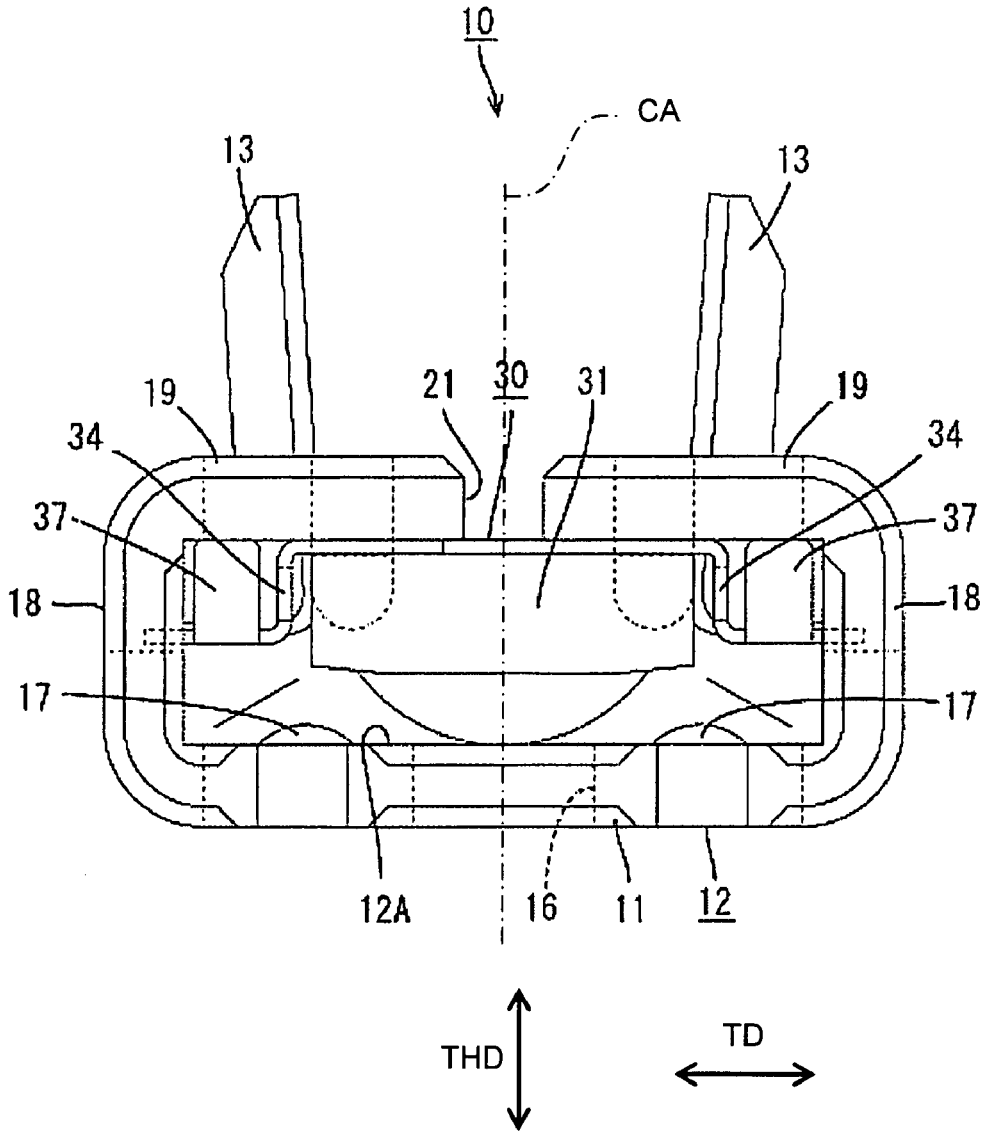
FIG. 2 is a front view of the female terminal fitting.
Figure 3:
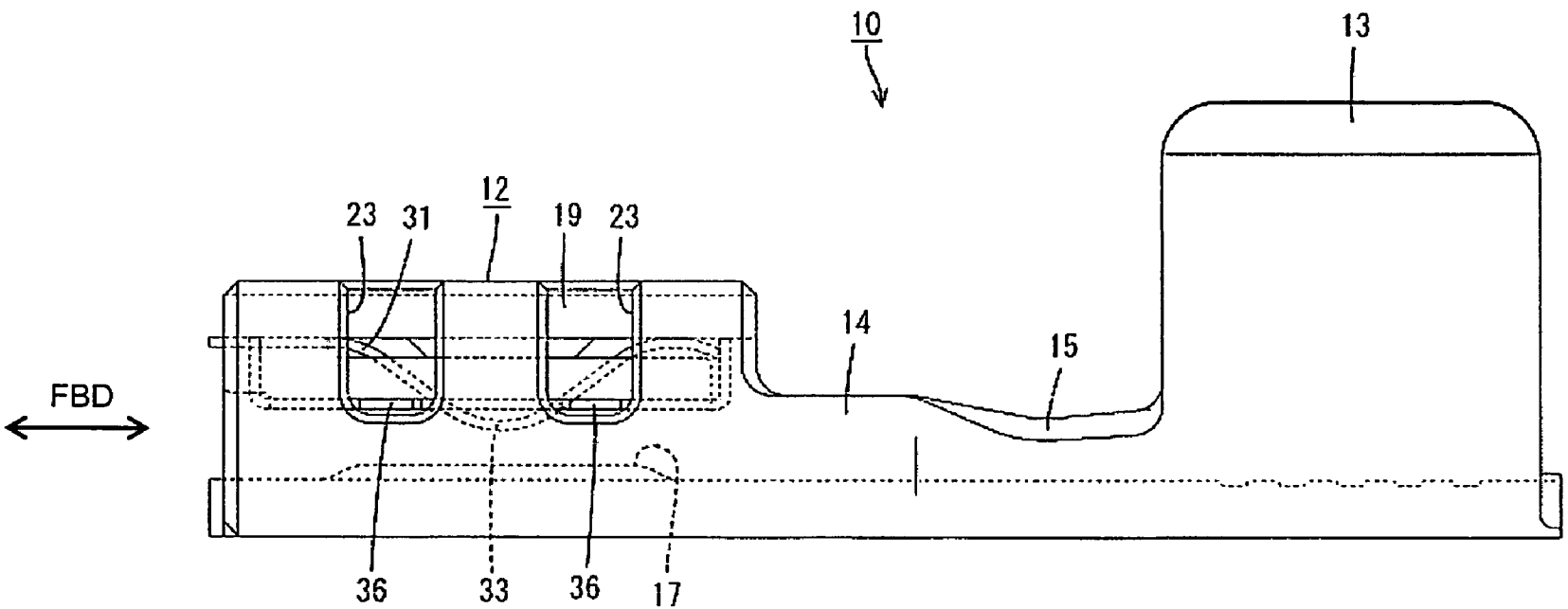
FIG. 3 is a side view of the female terminal fitting.
Figure 4:
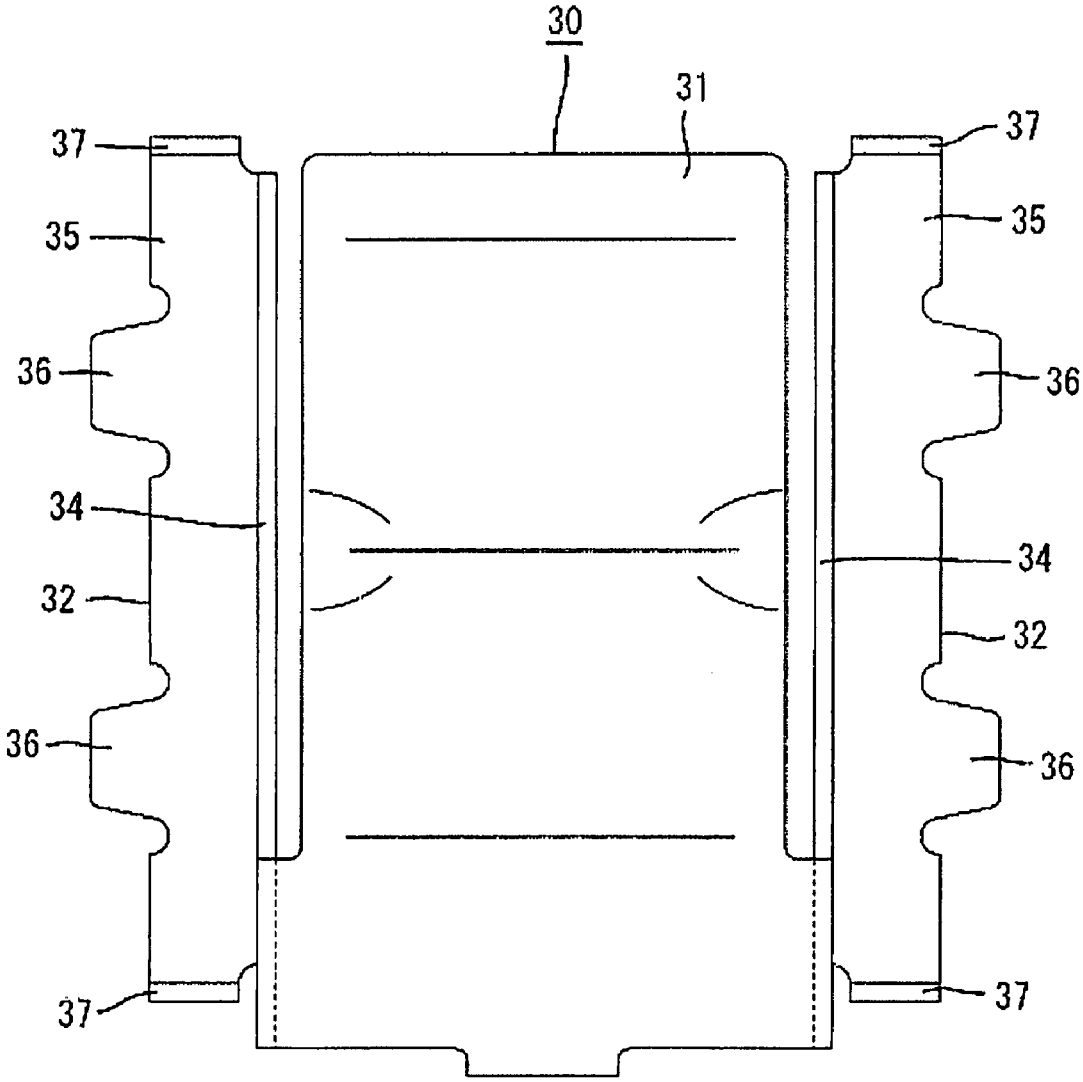
FIG. 4 is a side view in section of the female terminal fitting.

A female terminal fitting in accordance with the invention is identified generally by the numeral 10 in FIGS. 1 to 9. The female terminal fitting 10 is connectable with a male tab 80, and can be accommodated in an unillustrated connector housing while being connected with an end of a wire. In the following description, a left side in FIG. 3 is a front end concerning forward and backward directions FBD and reference is made to FIG. 2 concerning the vertical direction.

The female terminal fitting 10 is made of an electrically conductive plate made preferably of metal. In order to cope with an unillustrated thick wire for large current, a relatively thick plate material is used. This female terminal fitting 10 includes a substantially flat base plate 11 that extends in forward and backward directions FBD. A substantially rectangular tube 12 is formed along a front part of the base plate 11 and a wire connection barrel 13 is formed along a rear part of the base plate 11. The wire connection barrel 13 can be crimped, bent or folded into connection with the wire by being wound at least partly around a core section exposed near the end of the wire.

Reinforcing plates 14 standing up from the opposite lateral edges of an intermediate part of the base plate 11 of the female terminal fitting 10. Front ends of the reinforcing plates 14 are connected with the base plate 11 and the rear ends thereof are connected with the wire connection barrel 13. The reinforcing plates 14A ensure a specified rigidity in an area between the tube 12 and the barrels 13. Upper ends of the reinforcing plates 14 are cut off to form stress absorbing portions 15 for substantially preventing bending stresses resulting from the crimp connection of the barrel 13 with the wire from being transmitted to the tube 12. The stress absorbing portions 15 are formed by recessing the upper ends of the reinforcing plates 14 near the barrel 13 to be slightly lower than the upper ends of the reinforcing plates 14 near the tube 12. The stress absorbing portions 15 substantially prevent deformation of the tube 12 following the crimp connection with the wire.

The front part of the base plate 11 is wide in transverse direction TD, the rear part is narrower than the front part, and the intermediate part thereof is narrowed gradually from the front towards the rear. A substantially rectangular locking hole 16 is formed in thickness direction THD at a widthwise intermediate section of the front part of the base plate 11, as shown in FIG. 2. Receiving pads 17 are embossed in the front part of the base plate 11 to project into the tube 12 at opposite left and right sides of the locking hole 16. The receiving pads 17 are substantially parallel ribs that extend substantially parallel to one another in forward and backward directions FBD.

As shown in FIG. 2, the tube 12 is formed unitarily by bending a metallic material to include left and right side plates 18 to project up from opposite lateral edges of the front part of the base plate 11. Inner and outer surfaces of the side plates 18 are aligned at substantially right angles to the inner and outer surfaces of the base plate 11, and are joined to the base plate 11 by substantially quarter circular sections. Left and right facing plates 19 are bent to extend in from the upper ends of the opposite side plates 18 and face the base plate 11. Inner and outer surfaces of the facing plates 19 are aligned at substantially right angles to the inner and outer surfaces of the side plates 18 and are joined to the side plates 18 by substantially quarter circular or rounded sections. A wide rectangular tab insertion opening 12A is formed in the front of the tube 12 for receiving the male tab 80. The substantially opposite facing plates 19 are of substantially identical size and shape, and a slit 21 extends in substantially forward and backward directions FBD between the facing edges thereof. Thus, the edges of the facing plates 19 are opposed to each other substantially in parallel with the slit 21 located therebetween.

Two cuts are made in each facing plate 19 and extend in substantially forward and backward directions FBD. Areas between the cuts in each facing plate 19 are deformed inwardly to form left and right pressing portions 22. The left and right pressing portions 22 define substantially wave-like, pointed or rounded shapes that project towards the base plate 11. Two engaging holes 23 penetrate a portion of each facing plate 19 near the respective side plate 18 in a thickness direction TD, as shown in FIGS. 1 and 3. The two engaging holes 23 are spaced apart in forward and backward directions FBD.

Figure 7:
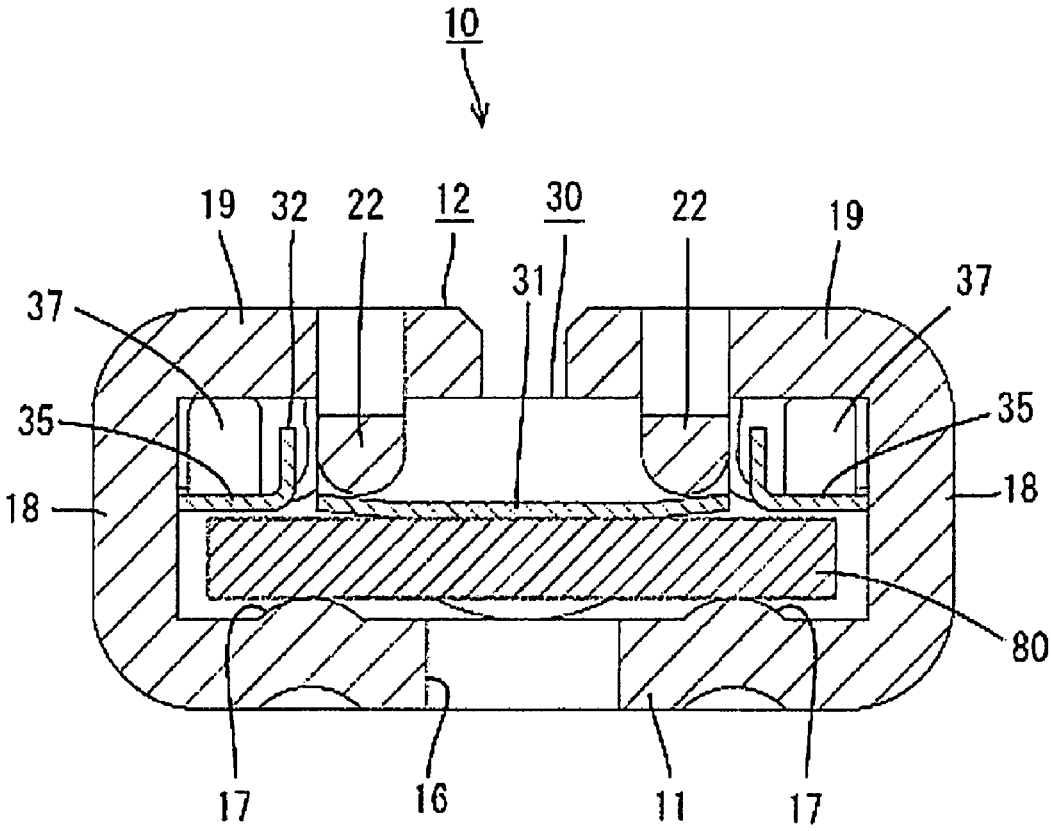
FIG. 7 is a plan view of a contact piece.
Figure 8:
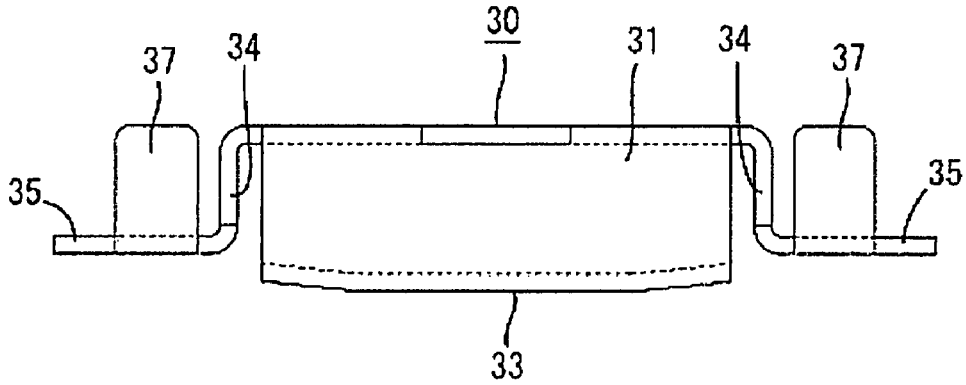
FIG. 8 is a front view of the contact piece.
Figure 9:
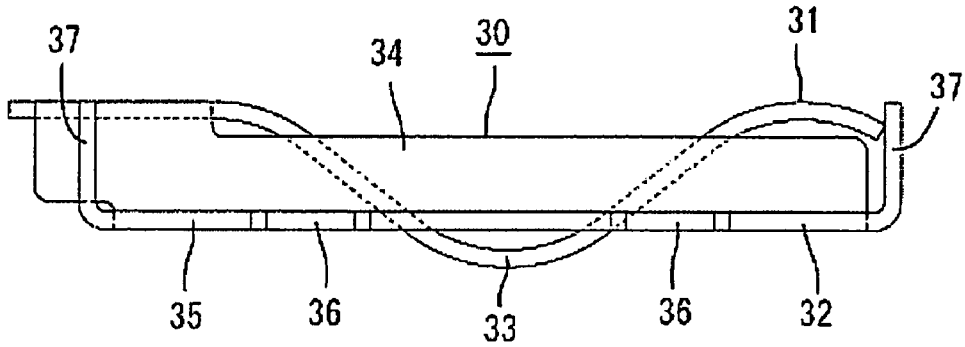
FIG. 9 is a side view of the contact piece.

A contact piece 30 is formed separate from the tube 12 and is arranged in the tube 12 at a position near the facing plates 19. A tab insertion path 50 is defined between the contact piece 30 and the receiving pads 17 for receiving the male tab 80. The contact piece 30 is thinner than the tube 12 and includes a strip-shaped contact main body 31 extending in substantially forward and backward directions FBD and is substantially in the form of a leaf spring that can be brought resiliently into contact with a widthwise middle part of the plate surface of the male tab 80, as shown in FIGS. 7 to 9. Substantially non-resilient shake preventing portions 32 extend from the opposite lateral edges of the contact main body 31 and contact the opposite widthwise sides of the upper plate surface of the male tab 80 to prevent the male tab 80 from shaking about the center of axis thereof.

The contact main body 31 defines a wave-like curve when seen from the side (see FIG. 3). An intermediate part in the extending direction of the contact main body 31 is closest to the receiving pads 17 and a contact portion 33 with the male tab 80 is formed on the top of this intermediate part. The convex surface of the contact portion 33 can be held in substantially line contact with the male tab 80. The pressing portions 22 are in spaced parallel relationship with the opposite widthwise ends of the plate surface of the contact main body 31 when the contact main body 31 is in its natural state. The tab insertion path 50 defines a clearance between the contact position of the contact portion 33 and the receiving pads 17 that is smaller than the thickness of the male tab 80 before the male tab 80 is inserted. This clearance is widened as the male tab 80 is inserted.

The left and right shake preventing portions 32 are formed unitarily with the opposite widthwise edges of the contact main body 31 and are substantially in the form of wings. More specifically, each shake preventing portion 32 has a hanging portion 34 that is bent to extend towards the base plate 11 at a substantially right angle from the corresponding lateral edge of the front end of the contact main body 31. A shake preventing body 35 is bent to project out in the transverse direction TD at a right angle from the bottom end of the hanging portion 34 to define a substantially L-shaped cross section. The hanging portions 34 extend in forward and backward directions FBD and the opposite front and rear ends thereof are at substantially the same positions as the opposite front and rear ends of the contact main body 31. The hanging length of the hanging portions 34 is less than the depth of the curve of the contact main body 31.

The shake preventing bodies 35 also extend in forward and backward directions FBD, and have substantially the same length in forward and backward direction FBD as the hanging portions 34, and preferably are substantially transversely symmetrical with respect to a central axis CA of the contact piece 30 and the terminal fitting 10. A distance between the projecting edges of the left and right shake preventing bodies 35 is substantially equal to or slightly less than the inner width of the tube 12. The lower surfaces of the shake preventing bodies 35 can be brought into surface contact with the plate surface of the male tab 80. A clearance equal to or slightly larger than the thickness of the male tab 80 is defined between the contact surfaces of the shake preventing bodies 35 and the receiving pads 17 at the inner surface of the base plate 11 when the contact piece 30 is mounted in the tube 12. The contact surfaces of the shake preventing bodies 35 are lower than the contact position of the contact main body 31 in the height direction when the contact main body 31 is in its natural state, and most part of the contact main body 31 projects from the contact position when viewed sideways.

Engaging pieces 36 bulge laterally out from lateral edges of the shake preventing portions 35 at the sides of the contact piece 30 and at positions corresponding to the engaging holes 23. The engaging pieces 36 are insertable into the engaging holes 23 from the inner side to hold the contact piece 30 in the tube 12 and to prevent loose movements. In this way, the contact piece 30 is mounted into the tubular portion 12.

Opposite longitudinal ends of each shake preventing body 35 are bent up at substantially right angles towards the facing plate 19 to form front and rear supports 37 with upper ends that contact the inner surfaces of the facing plates 19 when the contact piece 30 is mounted into the tube 12 to prevent loose movements of the contact piece 30 in the tube 12. The supports 37 are substantially rectangular in front view. The standing distance of the supports 37 is substantially equal to the hanging distance of the hanging portions 34. The shake preventing bodies 35 are held substantially immovably in position by the supports 37, and the contact surfaces are kept substantially horizontal.

The female terminal fitting 10 is assembled by initially arranging the contact piece 30 at a surface of a flat conductive piece that will become the inside surface of the tube 12. The metal piece then is bent in the transverse direction TD to form the tube 12. The engaging pieces 36 of the contact piece 30 enter the engaging holes 23 of the tube 12 as the side plates 18 of the tube 12 are bent to project up. In this way, the contact piece 30 is engaged with and held in the tube 12. Additionally, the contact portion 33 of the contact main body 31 moves closer to the receiving pads 17, the shake preventing bodies 35 come to be arranged substantially horizontally along an inserting direction ID of the male tab 80, and the leading ends of the supports 37 contact the inner surfaces of the facing plates 19 of the tube 12. Further, the wire connection barrel 13 is crimped, bent or folded into connection with an end of a wire to connect the female terminal fitting 10 electrically with the wire.

Figure 5:
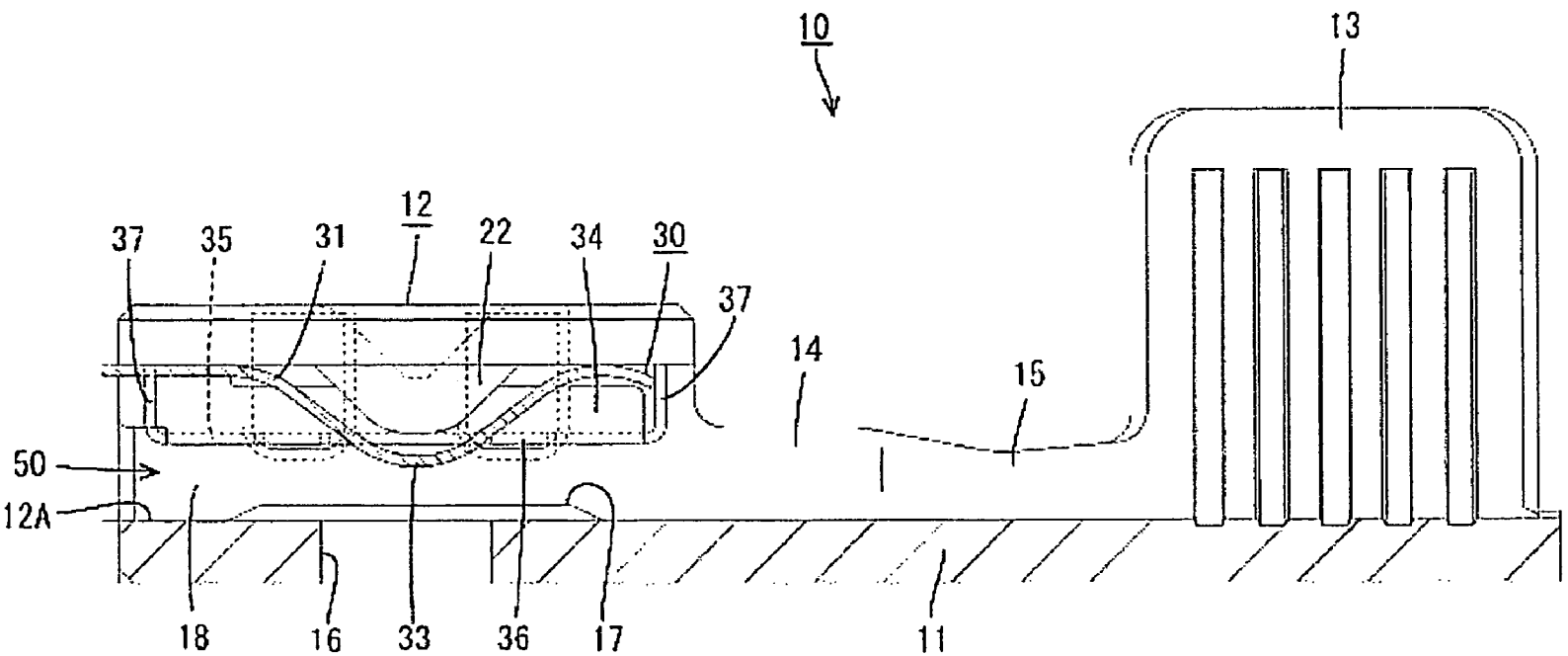
FIG. 5 is a side view in section showing an essential portion of the female terminal fitting connected with a male tab.
Figure 6:
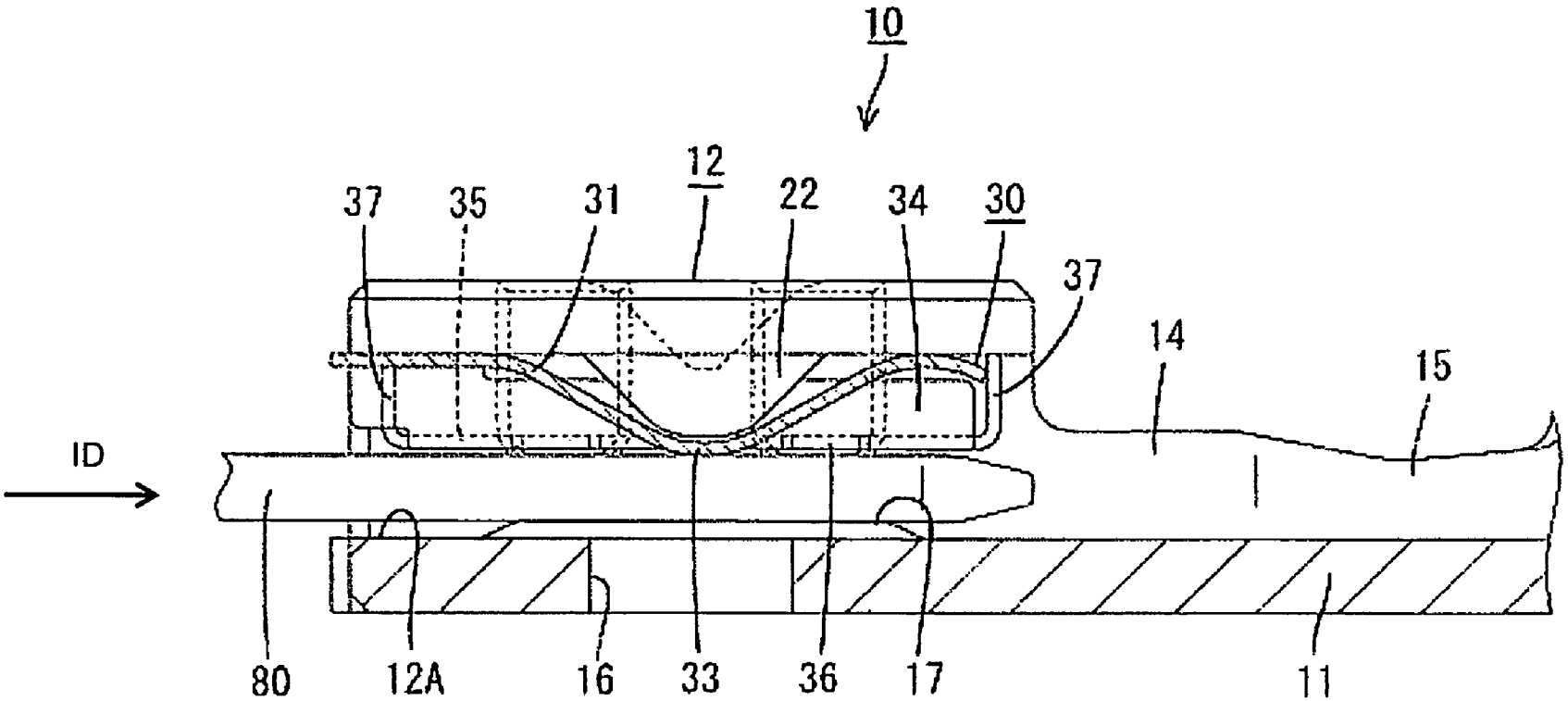
FIG. 6 is a vertical section showing the essential portion of the female terminal fitting connected with the male tab.

Subsequently, the female terminal fitting 10 connected with the wire is inserted into a cavity of the unillustrated connector housing. When the female terminal fitting 10 is inserted to a proper depth, a resin lock formed at an inner wall of the cavity is fit into the locking hole 16 of the tube 12 to hold the female terminal fitting 10 in the housing. The housing can be connected with a mating housing that accommodates a male terminal fitting. As a result, the male tab 80 enters the tube 12 in the inserting direction ID through the tab insertion opening 12A and pushes the contact main body 31 of the contact piece 30 resiliently up in a direction substantially normal to the inserting direction ID, as shown in FIGS. 5 and 6. In this way, the male tab 80 is supported in the tube 12 while being held between the contact portion 33 of the contact main body 31 and the receiving pads 17 for electrical connection with the female terminal fitting 10. The upper surface of the male tab 80 is in proximity to the contact surfaces of the shake preventing bodies 35 while defining a very small clearance or lightly in contact with the contact surfaces of the shake preventing bodies 35 when the male tab 80 is inserted properly into the tube 12.

The tube 12 may be displaced if the wire is shaken in a direction intersecting with the longitudinal direction thereof while the female and male terminal fittings are connected. However, following a shaking movement of the wire, the opposite widthwise ends of the upper surface of the male tab 80 are pressed by the shake preventing portions 32 even if the tube 12 is displaced, and the opposite widthwise ends of the lower surface thereof is pressed by the receiving pads 17 to prevent a shaking movement about the center of axis CA thereof. Therefore, a relative position of the male tab 80 in the tube 12 will not change significantly.

As described above, the shake preventing portions 32 of the contact piece 30 prevent shaking movements of the male tab 80 in the tube 12 and hence improve connection reliability of the male tab 80 and the female terminal fitting 10. Further, the shake preventing portions 32 at the opposite sides of the contact main body 31 have substantially the same length as the contact main body 31 and suppress shaking movements of the male tab 80 along or about the longitudinal direction.

Further, the front supports 37 and the rear supports 37 prevent the shake preventing portions 32 from being displaced in the tube 12 and reliably suppress shaking movements of the male tab 80. Additionally, the contact piece 30 is separate from the tube 12, and the thickness of the contact piece 30 can be set to a desired value regardless of the thickness of the tube 12. Accordingly, smooth resilient deformations of the contact main body 31 can be guaranteed preferably by the thinner contact main body 31.

Further, since the contact position of the contact main body 31 is distanced from the contact surfaces of the shake preventing portions 35 in height direction when the contact main body 31 is in its natural state and not in contact with the male tab 80. Thus, a contact pressure of the contact main body 31 with the male tab 80 can be set to a proper value so that the contact surfaces of the shake preventing portions 35 and the upper surface of the male tab 80 are not strongly in contact with each other. As a result, an increase in the insertion resistance of the male tab 80 is suppressed.

The invention is not limited to the above described and illustrated embodiment. For example, the following embodiments also are embraced by the technical scope of the invention. Beside the following embodiments, various changes can be made without departing from the spirit of the invention.

The shake preventing portions are formed at the opposite sides of the contact main body to have substantially the same length as the contact main body in the foregoing embodiment. However, the shake preventing portions may be formed at least at the opposite sides of the contact portion of the contact main body or at least in an area from the tab insertion opening to the contact position according to the invention.

The supports hold shake preventing portions in the tube to prevent loose movements by the supporting portions in the foregoing embodiment. However, the shake preventing portions may be fixed in the tube by the close engagement of the engaging pieces with the engaging holes.

The contact piece is separate from the tube in the foregoing embodiment. However, it may be integral or unitary to the tube according to the invention. For example, the contact piece may be an angled member pointing up or in and folded back at the front end of the base plate of the tube.

The contact main body has a wavy shape in the foregoing embodiment. However, the contact main body may be bent or curved with only one inwardly oriented convex or bent portion.

What is claimed is:

1. A female terminal fitting, comprising:

a tube with a tab insertion opening at one end for receiving a male tab, at least one receiving pad formed in the tube; and a contact piece at least partly in the tube and substantially opposed to the receiving pad, the contact piece including a resiliently deformable contact main body curved in a thickness direction to define a convex surface that approaches the receiving pad, the contact piece being resiliently engageable with a widthwise intermediate part of the male tab at a contact position of the convex surface, and at least one shake preventing portion formed along an inserting direction of the male tab at least at one lateral side of the contact main body and configured to contact widthwise sides of the male tab to prevent the male tab from shaking about a center of axis of the male tab, the shake preventing portion including a hanging portion bent from a lateral edge of a contact main body to extend angularly towards the base plate of the tube, the shake preventing portion further including a shake preventing body bent to bulge out in a transverse direction from an end of the hanging portion so that the shake preventing portion has a substantially L-shape.

2. The female terminal fitting of claim 1, wherein the at least one shake preventing portion extends in an area from the tab insertion opening to a contact position on the curve.

3. The female terminal fitting of claim 1, wherein the contact piece further includes at least one support standing up substantially in the thickness direction of the shake preventing portion and configured to contact an inner surface of the tube for preventing loose movements of the contact piece in the tube.

4. The female terminal fitting of claim 1 wherein the contact piece is separate from the tube.

5. The female terminal fitting of claim 4, wherein the contact piece is held at least partly in the tube by engagement of at least one engaging portion substantially at an edge of the shake preventing portions located in proximity to widthwise sides of the contact piece and at least one engagement receiving portion at side walls of the tube.

6. The female terminal fitting of claim 1, wherein the contact position is distanced from contact surfaces of the shake preventing portions with the male tab in a height direction when the contact main body is not connected with the male tab.

7. The female terminal fitting of claim 1, wherein at least one pressing portion projects towards a base plate of the female terminal fitting to prevent excessive deformation of the contact main body of the contact piece, the pressing portions being formed by deforming portions of the tube inwardly.

8. The female terminal fitting of claim 1, wherein the contact main body has a curved wavy shape.

9. A female terminal fitting, comprising:

a substantially rectangular tube having a base plate, opposed side plates extending angularly from the base plate and facing plates extending from the side plates and substantially opposed to the base plate, a tab insertion opening at one end of the tube; and a contact piece formed separately from the tube and disposed in the tube substantially opposed to the base plate, the contact piece including a resiliently deformable contact main body curved in a thickness direction to define a convex surface that approaches the base plate, two opposed shake preventing portions formed along opposite lateral sides of the contact main body, the shake preventing portions having hanging portions bent from opposite lateral edges of the contact main body and extending angularly towards the base plate of the tube and shake preventing bodies bent respectively from the hanging portions and extending laterally out from the respective hanging portions towards the respective side plates so that each of the shake preventing portions has a substantially L-shape.

10. The female terminal fitting of claim 9, wherein the base plate is formed with at least receiving pad projecting into the tube and towards the contact piece.

11. The female terminal fitting of claim 10, wherein each shake preventing portion further includes at least one support projecting away from the base plate and configured to contact an inner surface of the tube for preventing loose movements of the contact piece in the tube.

12. The female terminal fitting of claim 11, wherein the contact piece is formed from a metal material thinner than the tube.

13. The female terminal fitting of claim 11, wherein the tube is formed with engagement receiving portions, the contact piece having engaging portions at an edge of each of the shake preventing portions, the engaging portions being held by the engagement receiving portion for positioning the contact piece in the tube.

14. The female terminal fitting of claim 13, wherein the contact piece is formed from a metal material thinner than the tube.

* * * * *